United States Patent [19]

Wilson

[11] 4,121,388

[45] Oct. 24, 1978

[54] ABRASIVE SURFACE TREATING DEVICE

[75] Inventor: Dale Ray Wilson, Comanche, Okla.

[73] Assignee: Hayden Dillard, Duncan, Okla.

[21] Appl. No.: 813,987

[22] Filed: Jul. 8, 1977

[51] Int. Cl.[2] ..... B24C 3/06

[52] U.S. Cl. ..... 51/424; 51/428; 51/429

[58] Field of Search ..... 51/424, 429, 431, 435, 51/434, 428; 239/224

[56] References Cited

U.S. PATENT DOCUMENTS

| | | | |
|---|---|---|---|
| 2,263,321 | 11/1941 | Unger | 51/431 |
| 3,217,447 | 11/1965 | Canale | 51/431 X |
| 3,405,481 | 10/1968 | Harper | 51/434 X |
| 3,756,377 | 9/1973 | Goff | 51/429 X |
| 3,788,010 | 1/1974 | Goff | 51/431 X |

FOREIGN PATENT DOCUMENTS

| | | | |
|---|---|---|---|
| 252,120 | 10/1970 | U.S.S.R. | 51/429 |

*Primary Examiner*—Gary L. Smith

*Attorney, Agent, or Firm*—Lane, Aitken, Dunner & Ziems

[57] ABSTRACT

A mobile, abrasive, surface treating device in which an impeller fan is disposed within a circular housing to direct a stream of abrasive material from a hopper against the treated surface in a blasting fashion. A movable frame assembly supports the open face of the housing in abutment with the treated surface, and a resilient element on the housing prevents dispersal of the abrasive material. The spent abrasive material is recovered and recycled by a continuous bucket conveyor system. Fluid motors cooperate with a system of winches and cables to control movement of the device over the treated surface.

6 Claims, 7 Drawing Figures

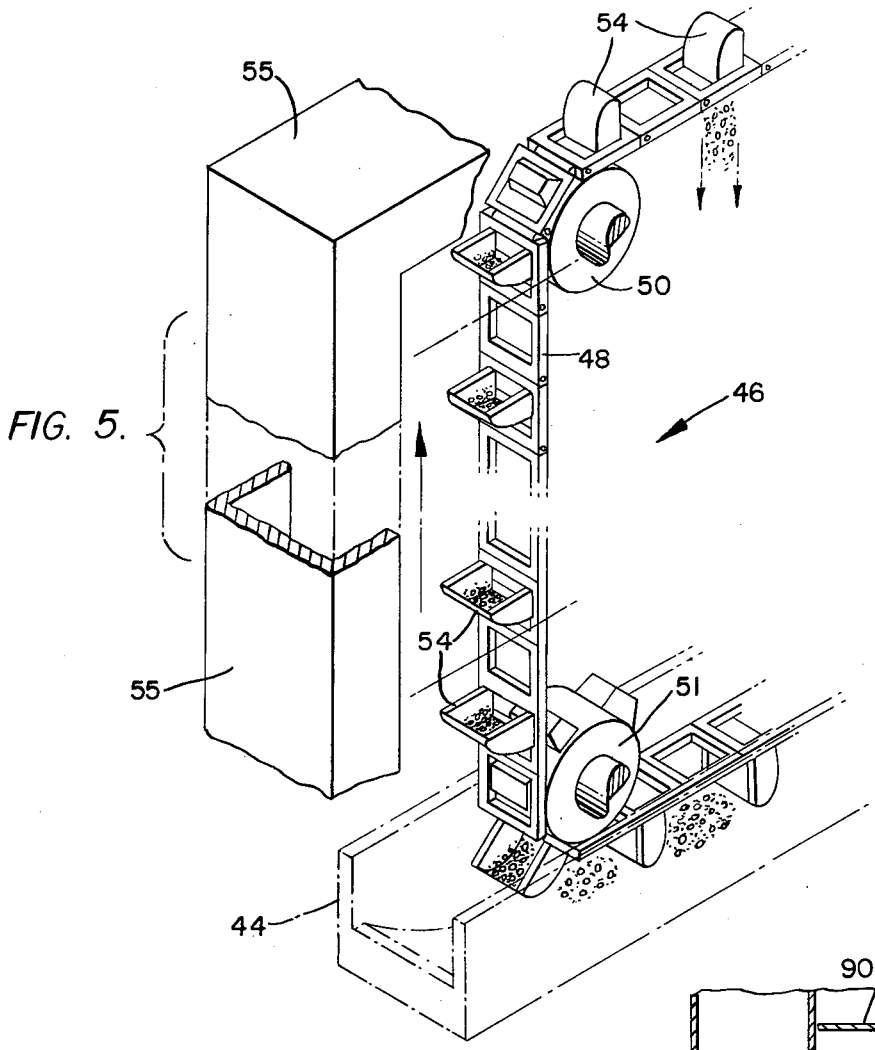
FIG. 5.
FIG. 7.
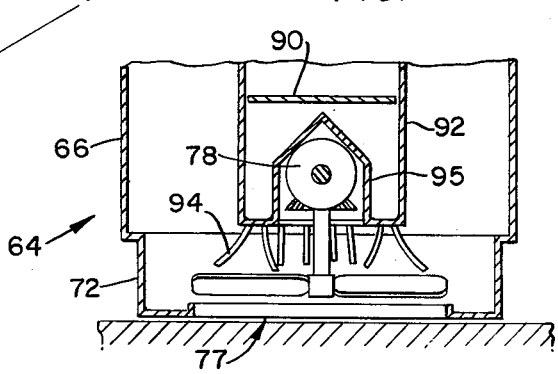
FIG. 6.
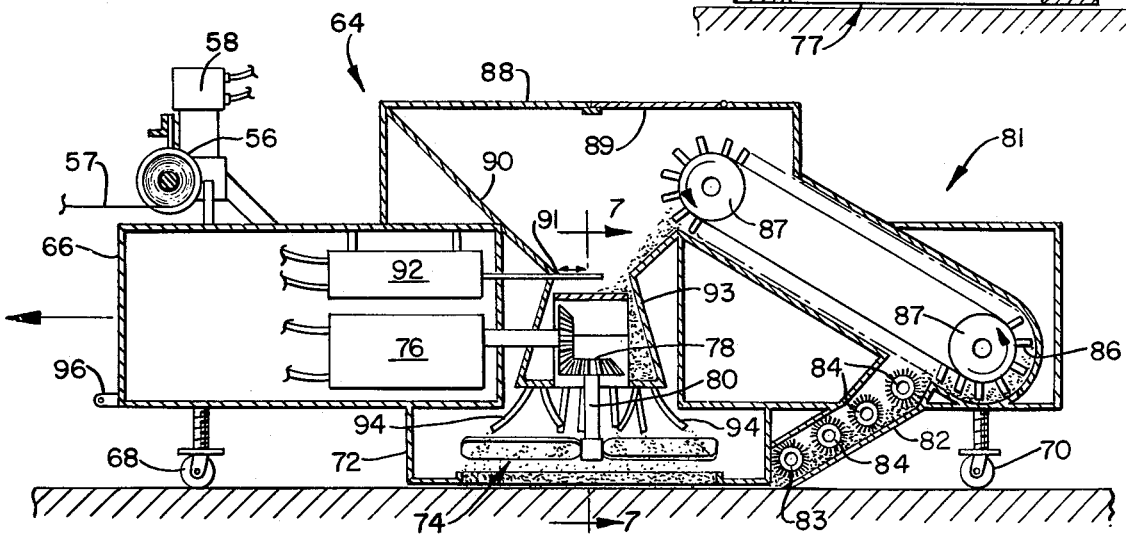

ABRASIVE SURFACE TREATING DEVICE

BACKGROUND OF THE INVENTION

The present invention relates to abrasive cleaning apparatuses and, more particularly, to a mobile, abrasive cleaning device having means for recovering and recirculating the abrasive material.

The abrasive cleaning of surfaces may be accomplished by a number of methods, such as the use of portable grinders and blasting. The use of portable grinders is a slow and expensive operation, particularly for large surface areas, which also produces an environment of dust, rust, dirt, etc. In addition to presenting a potential health hazard to the personnel operating the grinders, the cloud of dust, rust, and dirt prevents the conduct of other operations or procedures in the area where the grinders are being used.

Blasting methods are more efficient than the use of portable grinders, but again, a potentially hazardous environment is presented by the cloud of abrasive material, rust, dirt, etc. In addition to these deficiencies that the blasting methods share with the use of portable grinders, another disadvantage results from the additional operation in which the spent abrasive material has to be recovered, separated from the foreign material and processed for reused, or be collected and discarded.

Devices are known which provide for controlling the dust environment created by operation of a blasting machine and also provide for recirculating the spent abrasive material. Examples of blasting machines which incorporate such devices are described in U.S. Pat. Nos. 3,977,128, 3,906,673, and 3,756,377. Each of these machines uses a power-driven, centrifugal blast wheel, into which a stream of abrasive material is axially fed, to be centrifugally expelled against a surface to be cleaned. The means for recovering and recycling the spent abrasive material include rotating brushes or pneumatic suction apparatuses. Normally, the area which is cleaned at any given time by these machines is generally rectangular in shape and is of limited dimensions. Therefore, considerable time is required to clean a sizable surface area. Additionally, some of these machines are heavy and bulky, and consequently are difficult to maneuver and require considerable manpower in their operation.

Another category of abrasive cleaning devices includes large stationary machines used to treat the surfaces of a material passed through the machines. In such machines, the abrasive material may be centrifugally directed against the material surfaces by a blast wheel, such as described in U.S. Pat. No. 3,517,465, or be downwardly directed by a fan-type impeller, such as described in U.S. Pat. Nos. 3,405,481 and 3,217,447. Examples of the devices provided in these machines for collecting, processing and recycling the spent abrasive material include pneumatic exhaust systems, endless bucket conveyor systems, or screw conveyors, with the latter two utilizing gravity to collect the spent abrasive material and a conveyor system to transport this material back into the abrasive feeding apparatus. These abrasive, surface treating machines, because of their stationary nature, are massive in size, and are not intended to be mobile nor designed to clean large, fixed surface areas.

SUMMARY OF THE INVENTION

It is, therefore, an object of the present invention to provide an improved, abrasive, surface treating device which is lightweight and mobile.

Another object of the invention is to provide an improved, mobile, abrasive, surface treating device which does not generate a hazardous environment for the operating personnel.

Still another object of the present invention is to provide an improved, mobile, abrasive, surface treating device which can use any type of abrasive cleaning material.

A further object of the present invention is to provide an improved, mobile, abrasive, surface treating device having novel means to recover and recycle the spent abrasive material.

Yet another object of the present invention is to provide an improved, mobile, abrasive, surface treating device that treats a large surface area at any given time.

Yet a further object of the present invention is to provide an improved, mobile, abrasive, surface treating device that may be used to treat both horizontal and vertical surfaces with equal facility.

Toward the fulfillment of these and other objects, the mobile, abrasive, surface treating device of the present invention includes a frame assembly movably supported on a plurality of wheels. Supported on the frame assembly is a circular housing for a fan-type impeller, with the open end of the housing being positioned parallel to the surface to be treated. A hopper for abrasive material is supported adjacent one end of the frame assembly and is connected to the housing to supply a stream of abrasive material into the impeller, which directs the abrasive material against the surface to be treated. The edge of the housing is provided with a resilient sealing member designed to abut against the surface to be treated to contain the abrasive material and to prevent its dispersal into the surrounding atmosphere. The spent abrasive material is collected within a chamber adjacent to the other end of the frame assembly, and a bucket type conveyor system moves around the periphery of the frame assembly, passing through the collection chamber to return the spent abrasive material to the hopper for re-use. A system of winches and cables is supported on the frame assembly to be operatively connected to appropriate means for moving the abrasive cleaning device over the surface to be treated. An alternate configuration includes modifications to the support wheel system and the spent abrasive material collection and recycling system which readily adapt the device for use in cleaning horizontal surfaces.

The overall device is fabricated from lightweight material, such as aluminum, so that two men can manipulate and control the device with ease. The circular configuration of the impeller fan provides the capability for treating large surface areas.

BRIEF DESCRIPTION OF THE DRAWINGS

The above description, as well as further objects, features, and advantages of the present invention will be more fully appreciated by reference to the following description of presently-preferred but nonetheless illustrative embodiments in accordance with the present invention, when taken in connection with the accompanying drawings, wherein:

FIG. 5 is a pictorial, perspective view showing a fragmentary portion of the conveyor system for recycling the spent abrasive material.

FIG. 6 is a side elevational view showing an alternate configuration of the abrasive cleaning device in the horizontal-surface cleaning mode; and FIG. 7 is a cross-sectional view of the abrasive cleaning device, taken along line 7—7 in FIG. 6.

DESCRIPTION OF THE PREFERRED EMBODIMENTS

Figure 1:
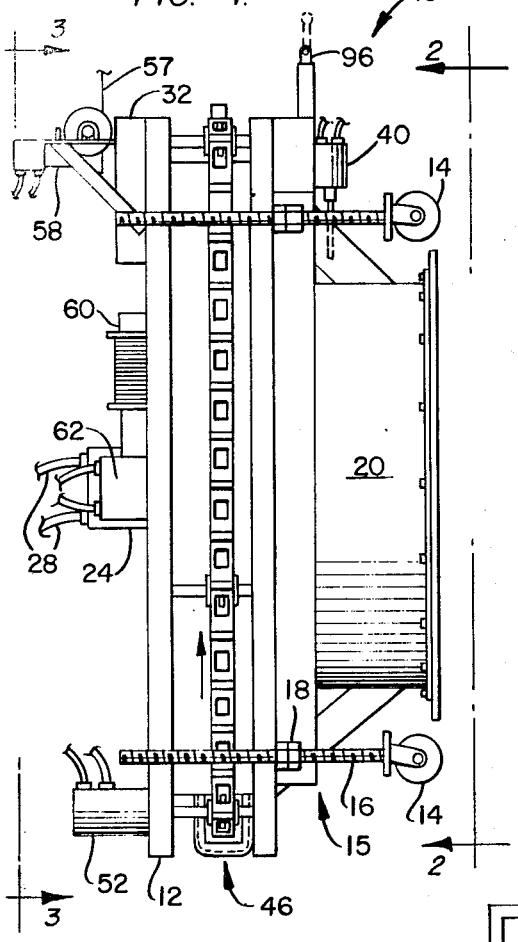
FIG. 1 is a side elevational view showing the abrasive cleaning device of the present invention positioned in the vertical-surface cleaning mode.
Figure 2:
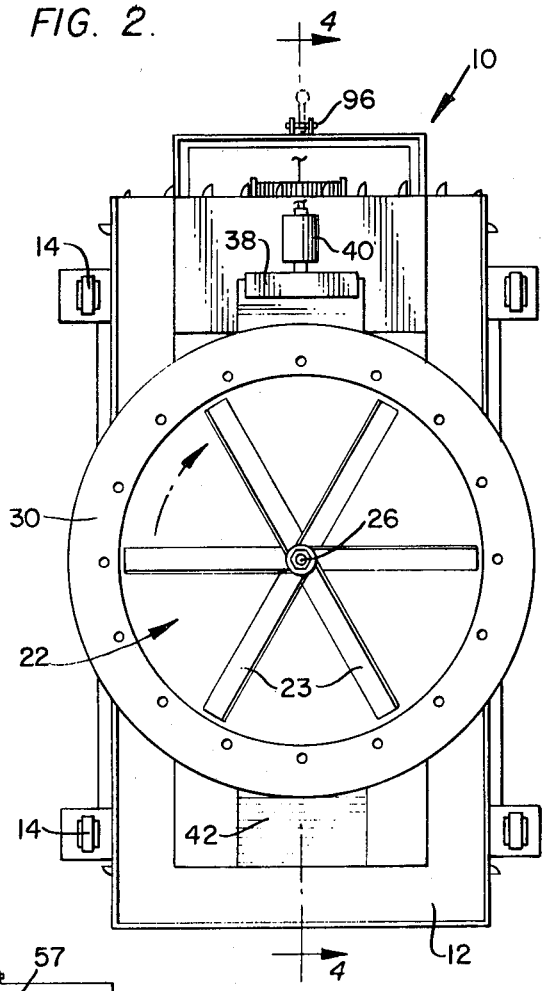
FIG. 2 is a front view of the abrasive cleaning device, as seen along line 2—2 of FIG. 1.
Figure 3:
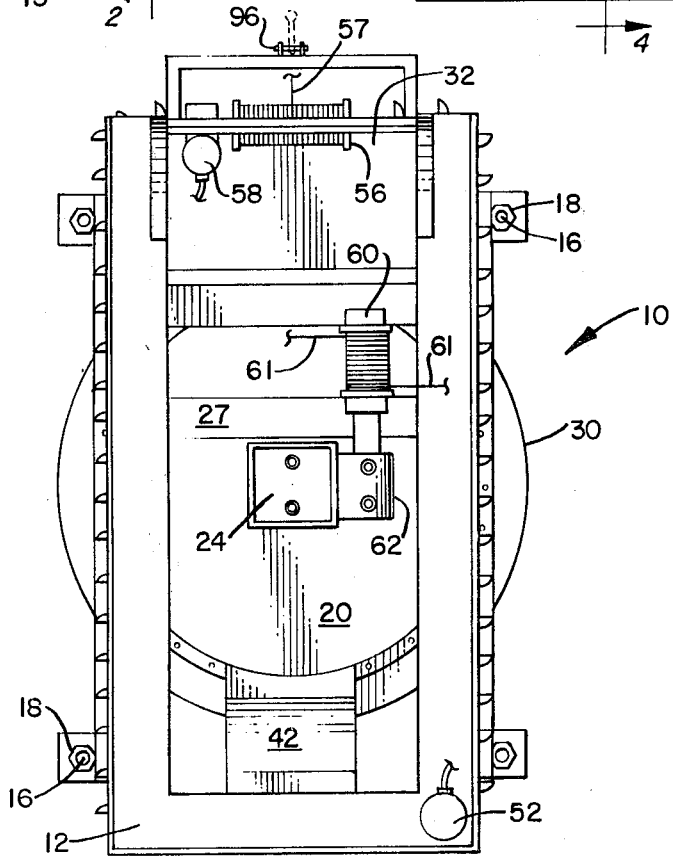
FIG. 3 is a back view of the abrasive cleaning device, as seen along line 3—3 in FIG. 1.

Referring to FIGS. 1-3 of the drawings, the reference numeral 10 refers generally to an abrasive cleaning device having a substantially rectangular frame assembly 12 movably supported by a plurality of wheels 14. Each wheel 14 is attached to a vertical adjustment unit 15 including a threaded rod 16 cooperating with an adjusting nut 18. The vertical adjustment unit 15 permits adjustments of the relative position between the abrasive cleaning device 10 and the surface on which the wheels 14 are supported.

Centrally supported on the frame assembly 12 is a circular housing 20, which is closed at the end attached to the frame assembly, and is open at the other end to enclose an impeller fan 22 having a plurality of blades 23. The open end of the circular housing 20 is positioned parallel to the frame assembly 12 and to the surface supporting the abrasive cleaning device 10. The inner surface of the housing 20 and the surfaces of the fan blades 23 may be coated with a layer of abrasion-resistant material to increase their service life. A fan drive motor 24, which may be hydraulically operated, rotates the blades 23 of the impeller fan 22 through a fan shaft 26. The fan drive motor 24 is suitably supported on the frame assembly 12 by a cross member 27 secured at its ends to the sides of the frame assembly. Fluid hoses 28 connect the fan drive motor 24 to an appropriate source of pressurized fluid (not shown) to operate the motor in a conventional manner. Attached to the circumferential rim of the open end of the circular housing 20 is a flexible, annular flap 30, made of a suitable resilient material, such as silicone-reinforced rubber or plastic, which provides a fluid seal between the housing and the surface to be treated, as described more fully below.

Supported upon one end of the frame assembly 12, such as the upper end as shown in FIG. 1, is a hopper 32 which receives a supply of abrasive material used in the cleaning of a surface. This abrasive material may be sand, grit, shots, or a synthetic material, with the choice being dependent upon the nature of the surface to be cleaned. The hopper 32 may be container of rectangular configuration, with an opening directed toward the upper portion of the device 10 in FIGS. 1-3 to receive the abrasive material. A suitable cover (not shown) is provided to close the hopper 32 after the abrasive material has been loaded.

Figure 4:
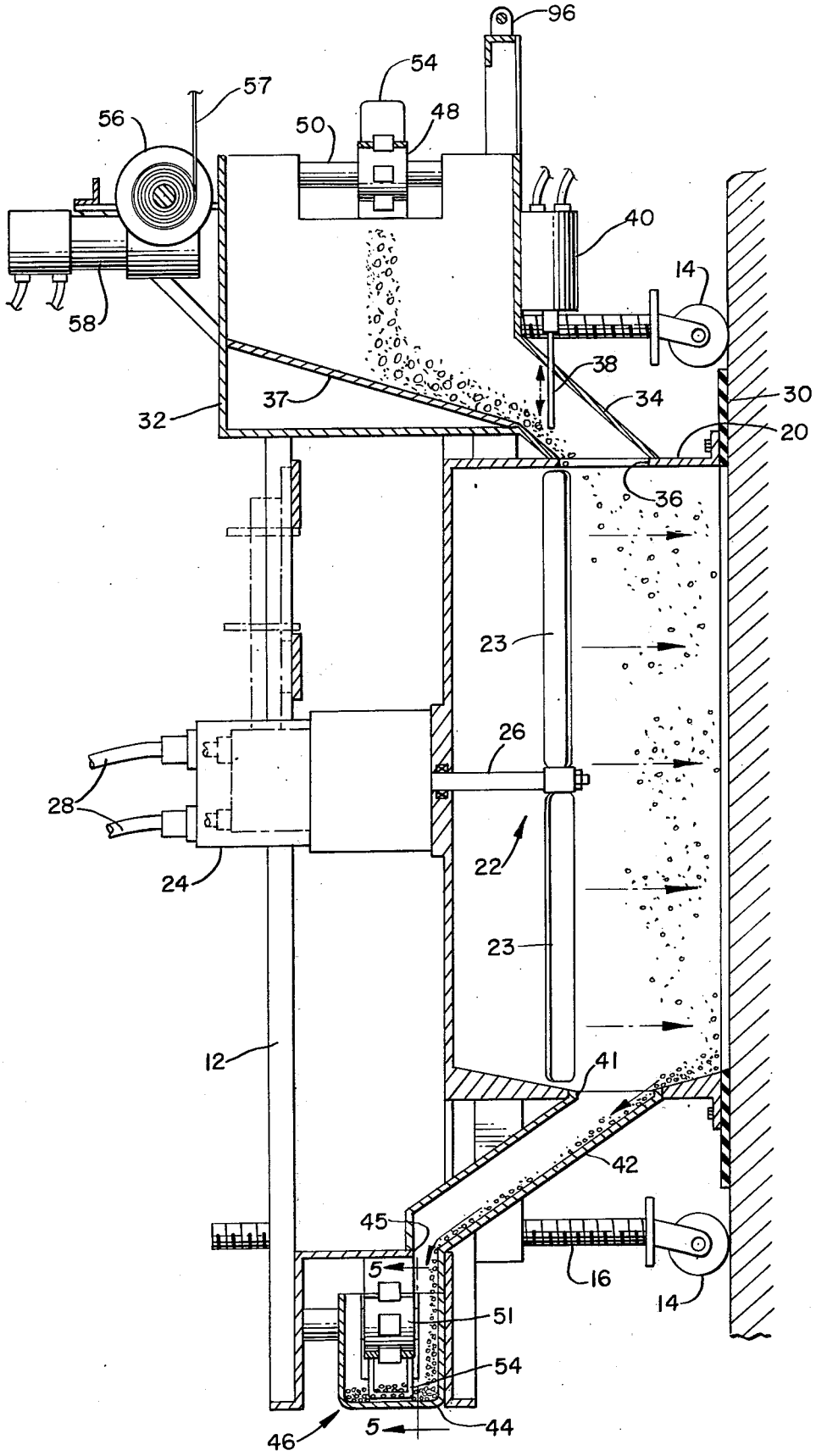
FIG. 4 is a cross-sectional view of the abrasive cleaning device, taken along line 4—4 in FIG. 2.

Referring to FIG. 4, a discharge chute 34 interconnects the hopper 32 with an inlet 36 provided in the sidewall of the housing 20. A plate 37, disposed at an angle, may be provided within the hopper 32 to facilitate the flow of the abrasive material to the chute 34. The flow of the abrasive material through the chute 34 is controlled by a plate valve 38, slidably supported within the chute and connected to a hydraulic motor 40, which operates in a conventional manner to control the reciprocal motion of the valve plate in a known fashion.

Disposed in the sidewall of the housing 20, substantially diametrically opposite the inlet 36, is an outlet 41. One end of a collector chute 42 is connected to the outlet 41, and the other end is connected to an opening 45 provided in the frame assembly 12, at the end of the frame assembly opposite from the location of the hopper 32. A collector channel 44, which may be of U-shaped cross section, is attached to the frame assembly 12, in a receiving position relative to the opening 45. The spent abrasive material is collected on the lower portion of the housing 20, flows through the outlet 41 and the collector chute 42, and into the collector channel 44 through the opening 45. The thickness of the portion of the side wall of the housing 20 adjacent to the outlet 41 may be tapered toward the outlet to facilitate collection and discharge of the spent abrasive material.

A conveyor system 46 (FIGS. 1, 4 and 5) is provided for recycling the collected, spent abrasive material, and includes an endless bucket chain 48 guided and supported by a plurality of sprockets 50 (FIG. 5), which may be suitably journalled upon the frame assembly 12. A journalled drive sprocket 51 is appropriately coupled to a motor 52, such as a hydraulic motor, for imparting motion to the conveyor system 46. A plurality of buckets 54, each having a curved scooping surface, are appropriately secured to the bucket chain 48 at predetermined intervals. A cover 55, fragmentarily shown in FIG. 5, may be provided which cooperates with the frame assembly 12 to enclose the conveyor system 46 to prevent dispersal of dirt, rust, dust, abrasive material, etc. into the surrounding area.

Movement of the abrasive cleaning device 10 is regulated by a system having components supported on the frame assembly 12, including a winch 56 with a length of cable 57 coiled thereon and rotated by a hydraulically-driven motor 58. Operation of the winch 56 regulates the longitudinal movement of the abrasive cleaning device 10, which in the vertical-surface cleaning mode would effect the lowering and raising of the device and, in the horizontal-surface cleaning mode, would effect the longitudinal, backward and foward motion of the device over the surface. Another component of the movement-regulating system is a side drive winch 60 (FIGS. 1 and 3), which is supported on the frame assembly 12 substantially perpendicular to the axis of the winch 56. A length of cable 61 is wrapped upon the side drive winch 60, the ends of which are free and extend from the winch. Connected to the side drive winch 60 is a motor 62, which may also be hydraulically driven, for rotating the winch to control the lateral movement of the abrasive cleaning device 10. The hydraulic hoses connected to the motors 24, 40, 52, 58 and 62 are coupled to one or more suitable sources (not shown) of pressurized fluid, and controls (not shown) regulate the fluid flow to control the operation of these motors.

In operation and assuming, for the purpose of illustration, that the abrasive cleaning device 10 is used to clean a vertical surface, such as the sidewall of an oil tank, the vertical sides of a ship or a building, or other similar structures, the free end of the cable 57 is appropriately attached to a suitable hoist (not shown) located adjacent to the upper end of the vertical surface to be cleaned. The free ends of the cable 61 of the side drive winch 60 are fixedly attached to means (not shown) disposed on the surface. Operation of the motor 58 rotates the winch 56, causing the abrasive cleaning device 10 to be suspended vertically in the orientation shown in FIGS. 1 and 4. In this position, the wheels 14 are adjusted by rotation of the adjusting nuts 18 so that the resilient flap 30 on the open edge of the circular housing 20 is in contact with the vertical surface, but still permit free movement of the abrasive cleaning device 10 over the surface. A suitable abrasive material is loaded into the hopper 32, and the cover securely attached. The cover 55 for the conveyor system 46 is normally appropriately secured in place.

The abrasive cleaning process is initiated by supplying pressurized fluid to the motor 24, causing the impeller fan 22 to rotate. Simultaneously, the motor 40 is operated to properly position the valve plate 38 within the chute 34 to regulate the flow of abrasive material from the hopper 32 and through the inlet 36 of the housing 20. The steady stream of abrasive material is directed with considerable force by the blades 23 of the impeller fan 22, in a blasting fashion, against the surface to be cleaned, with the abrasive material removing the dirt, rust, etc. The spent abrasive material falls toward the lower portion of the circular housing 20 and passes through the outlet 41, through the collection chute 42, through the opening 45 in the frame assembly 12, and into the collector channel 44.

Meanwhile, pressurized fluid is also supplied to the conveyor drive motor 52, causing movement of the bucket chain 48. As each of the buckets 54 passes through the collector channel 44, it scoops up a quantity of the spent abrasive material. The spent abrasive material, mixed with the dirt, rust, paint, etc. removed from the treated surface, is carried by the conveyor system 46 along the sides of the frame assembly 12, and passes over the hopper 32 to be discharged therein, thus recycling the abrasive material.

As the blasting action continues, the winch 56 is rotated to cause the abrasive cleaning device 10 to move along the vertical surface being cleaned. As the abrasive cleaning device 10 moves up to the upper limits of the vertical surface, the motor 62 is actuated to rotate the side drive winch 60, rotating the cable 61 wrapped thereon, and causing the cleaning device to move laterally. Subsequently, the winch 56 is operated in a reverse direction, lowering the abrasive cleaning device 10, and effecting cleaning of the vertical surface as the device is lowered. At the lower extremity of the vertical surface, the cleaning device again is moved laterally by rotation of the side drive winch 60, and the winch 56 is operated to cause the device to proceed upward along the vertical surface. This procedure is repeated until the entire surface has been cleaned. The amount of material removed from the cleaned surface may be controlled, in addition to the selection of the abrasive material, by regulation of the speed of the impeller fan 22.

An alternate configuration of the abrasive cleaning device is shown in FIGS. 6 and 7 which is particularly adapted for cleaning horizontal surfaces. The abrasive cleaning device, generally indicated by the reference character 64, includes an elongated housing 66 movably supported at its front end by a single, vertically-adjustable, steerable wheel 68 positioned along the longitudinal centerline of the housing, and a pair of vertically-adjustable wheels 70 positioned adjacent to the rear of the housing. An impeller shroud 72, similar in structure and function as the circular housing 20, is supported below the central portion of the housing 66 to enclose an impeller fan 74, which is rotatably driven by a motor 76, such as a hydraulic motor, via a gear set 78 and a fan shaft 80. The open end portion of the impeller shroud 72 is positioned parallel to the lower surface of the housing 66 and the surface to be cleaned.

A recycling system 81 is provided for the abrasive cleaning device 66 for collecting and recycling the spent abrasive material. The recycling system 81 includes a collection chute 82, which is angularly inclined upwardly and rearwardly from the trailing portion of the impeller shroud 72, with the mouth 83 of the chute close to the surface to be treated. Mounted for rotation within the collection chute 82 are a plurality of brushes 84 appropriately spaced along the length of the chute. A continuous bucket conveyor 86, structurally similar to the conveyor system 46, is rotatably supported at each end by a sprockets 87, and is positioned at an angle such that the lower end is disposed at the back of the cleaning device 64 and adjacent to the upper end of the collection chute 82, and the upper end is adjacent to an abrasive material hopper 88 supported on the upper surface of the housing 66 in vertical alignment with the impeller shroud 72. A door 89 provides access for loading the hopper 88 with abrasive material. Conventional means (not shown), such as the drive means described for the conveyor system 46, drive the bucket conveyor 86 and the brushes 84.

An inclined, funnel-shaped floor 90 is disposed within the hopper 88 to facilitate the flow of the abrasive material to the impeller fan 74. A slidable valve plate 91, connected to a control cylinder 92, is positioned at the narrow neck portion of the hopper floor 90 to regulate the flow of the abrasive material. Extending below the neck portion of the hopper 88 is a discharge chute 93, which directs the abrasive material to the impeller fan 74. A plurality of curved tubes 94 are disposed at the end of the discharge chute 93 to provide means for more evenly distributing the abrasive material over the diameter of the impeller fan 74.

Since the gear set 78 and the fan shaft 80 are located within the discharge chute 93 and in the flow path of the abrasive material, a protective enclosure 95 surrounds the gear set 78, as seen more clearly in FIG. 7. The top of the protective enclosure 95 may be slanted to divert the abrasive material toward the sides of the enclosure.

Longitudinal movement of the abrasive cleaning device 64 is regulated by a winch 56, cable 57 and motor 58 in substantially the same manner as described for the abrasive cleaning device 10 shown in FIGS. 1 through 5. A hitch 96 is secured to the front of the housing 66 for a purpose which will be described more fully below. While not specifically shown in FIGS. 6 and 7, movement-regulating means similar to the side drive winch 60 and cable 61 may be used to control lateral motion of the abrasive cleaning device 64.

In cleaning a horizontal surface, such as the floor or the top of an oil tank, the decks of a ship, or other similar surfaces, the wheels 68 and 70 of the abrasive cleaning device 64 are adjusted so that a clearance is provided between the open edge of the impeller shroud 72 and the horizontal surface to be cleaned. This clearance permits the abrasive cleaning device 64 to pass over the spent abrasive material deposited on the surface. The cable 57 is attached to an appropriate means which will direct the forward motion of the abrasive cleaning device 64 during the cleaning process. Also, a steering rod (not shown) may be attached to the hitch 96 which, in cooperation with the steerable wheel 68, permits close control of the cleaning device 64 adjacent to curved or irregular side surfaces. The control of the steering rod can be conveniently effected by power-operated or manual means. The appropriate abrasive material is loaded into the hopper 88, and the door 89 secured shut.

The operation of the abrasive cleaning device 64 in the horizontal-surface mode is similar to that described for the abrasive cleaning device 10 in the vertical-surface mode. The flow of the abrasive material from the hopper 88 is regulated by the valve plate 91, and the material is directed into the impeller fan 74 by the discharge chute 93, and around the periphery of the impeller fan by the curved tubes 94. The steady stream of abrasive material is directed by the impeller fan against the horizontal surface in a blasting fashion.

As the abrasive cleaning device 64 moves over the horizontal surface, the layer of spent abrasive material is swept up from the mouth 83 of the collector chute 82 by the rotation of the brushes 84 and directed into the bucket conveyor 86, which in turn dumps the recovered abrasive material back into the hopper 88. The operation and control of the hydraulic motors are identical to that previously described.

The foregoing abrasive cleaning devices may be fabricated from a lightweight material, such as aluminum, so that the devices may be placed in operation more quickly and two men may manipulate and control each device with ease. The use of fan-type impeller blades results in a quieter and a more vibration-free abrasive cleaning device than the slapper-type impellers of the prior art. The circular configuration of the impeller fan and the housing provide for a large, surface area treating capability, which may be further adjusted according to the size of the surface to be treated by the substitution of different-sized fans and housings. Thus, the diameter of the impeller fan can be increased or decreased accordingly, and presents a substantial advantage over the prior art cleaning apparatuses which can only treat a rectangular surface of three to four inches wide and eighteen to twenty-four inches long. Fan diameters of eighteen, thirty-six and sixty inches have been successfully employed and have proven efficient.

The resilient flange around the peripheral edge of the circular fan housing provides a dust-free sealing element which contains the mixture of spent abrasive material and paint, dirt, rust, etc., removed from the treated surface. In the configuration utilizing rotating brushes, the resulting mixture is removed as quickly as it is deposited, and the narrow separation between the shroud and the treated surface further prevents dispersal of the mixture. These factors contribute materially to the elimination of any potentially hazardous operating environment for the personnel using the cleaning devices. Further, the provision of a dust-free environment permits other operations to be conducted simultaneously within the area of the cleaning operation.

If desired, the recycled spent abrasive material may be passed through a filter or a separator, such as a conventional cyclone separator, which will separate the spent abrasive material from the substances removed from the treated surface. Such separators or filters may, for example, be conveniently attached to the abrasive material hopper. In general, however, unless the surface is in extremely poor condition, the amount of substance removed from the treated surface does not present an undue problem of contamination of the abrasive material.

Although not particularly illustrated in the drawings, it is understood that an appropriate source of pressurized fluid, fluid lines, and that the necessary quick-disconnect couplings will be furnished to effect a continuous, operative hydraulic system. A centralized control panel may be provided to regulate movement of the abrasive cleaning device, the flow of the abrasive material from the hopper, the speed of the impeller fan, and the speed of the recovery conveyor system.

Of course, variations of the specific construction and arrangement of the abrasive cleaning device disclosed above can be made by those skilled in the art without departing from the invention as defined in the appended claims.

What is claimed is:

1. A mobile device for the abrasive treatment of surfaces, comprising:

a frame assembly movably supported by a plurality of adjustable support means;

a circular housing having an open end portion and supported by said frame assembly such that the open end portion is disposed parallel to the surface to be treated;

a resilient sealing element on the open end portion of said housing and adapted to be positioned in abutting contact with the surface to be treated;

a driven, axial-flow fan disposed within said housing and having a plurality of blades supported on a rotatable shaft, said blades being oriented substantially parallel with the surface to be treated to direct a stream of air substantially parallel to said shaft;

containment means for a supply of abrasive material, including means for directing the abrasive material into said housing, downstream of said fan blades to entrain the abrasive material within the air stream produced by said fan, the flow of entrained abrasive material and air being directed substantially perpendicularly to the surface to be treated;

means for collecting the spent abrasive material, including a collection channel supported on said frame assembly for receiving the spent abrasive material;

means for recycling the spent abrasive material, including a conveyor system cooperating with said collecting means to return the spent abrasive material to said containment means, said conveyor system having a continuous conveyor element passing through said collection channel and passing adjacent to said containment means, a plurality of holding elements spaced along said conveyor element for carrying the spent abrasive material, and drive means operatively connected to said conveyor element for causing movement of said conveyor element;

cover means cooperating with said frame assembly to enclose said collection channel and said conveyor system; and a system for controlling the longitudinal and lateral motions of said frame assembly, said system having a fluid motor and a cooperating winch.

2. The surface treating device of claim 1, further including a fluid motor coupled to said fan shaft to rotatably drive said fan blades.

3. The surface treating device of claim 1, wherein said support means includes wheels supported on adjustment means for control of the spacing between said frame assembly and the surface to be treated, and said sealing element is an annular element disposed on the circumferential edge of the open portion of said housing to prevent escape of the abrasive material from said housing.

4. The surface treating device of claim 1, wherein said motion control system for said frame assembly includes:

a first fluid motor, a first cooperating winch, and a first length of cable on said first winch for controlling movement of said frame assembly along the longitudinal direction of said assembly; and a second fluid motor, a second cooperating winch, and a second length of cable on said second winch for controlling lateral movement of said frame assembly independently of the longitudinal movement of said assembly.

5. A mobile device for the abrasive treatment of surfaces, comprising:

a frame assembly movably supported by a plurality of adjustable support means;

a circular housing having an open end portion and supported by said frame assembly such that the open end portion is disposed parallel to the surface to be treated;

a resilient sealing element on the open end portion of said housing and adapted to be positioned in abutting contact with the surface to be treated;

a driven, axial-flow fan disposed within said housing and having a plurality of blades supported on a rotatable shaft, said blades being oriented substantially parallel with the surface to be treated to direct a stream of air substantially parallel to said shaft;

containment means coaxially aligned with said circular housing for a supply of abrasive material;

flow control means for introducing the abrasive material to said open end portion of said housing, including a flow passage disposed between said containment means and said other end of said housing, and a plurality of arcuate elements cooperating with said flow passage to direct the abrasive material toward the outer periphery of said driven axial fan, to entrain the abrasive material within the air stream produced by said fan, the flow of entrained abrasive material and air being directed substantially perpendicularly to the surface to be treated;

means for collecting the spent abrasive material, including a collection chute supported on said frame assembly and means for moving the spent abrasive material through the chute;

means for recycling the spent abrasive material, including a conveyor system cooperating with said collecting means to return the spent abrasive material to said containment means, said conveyor system having a continuous conveyor element passing adjacent said collection chute and passing adjacent to said containment means, a plurality of holding elements spaced along said conveyor element for carrying the spent abrasive material, and drive means operatively connected to said conveyor element for causing movement of said conveyor element; and a system for controlling the longitudinal and lateral motions of said frame assembly, said system having a fluid motor and a cooperating winch.

6. The surface treating device of claim 5, wherein said means for moving the spent abrasive material through said chute includes a plurality of rotatable elements for collecting the spent abrasive material from the treated surface, and said continuous conveyor element has one end positioned adjacent to said containment means and the other end positioned adjacent to said rotatable elements.

* * * * *